US008127951B2

(12) United States Patent
Conrad et al.

(10) Patent No.: US 8,127,951 B2
(45) Date of Patent: Mar. 6, 2012

(54) TELESCOPIC CRANE BOOM

(75) Inventors: Frank Conrad, Hornbach (DE); Jürgen Appel, Contwig (DE)

(73) Assignee: Terex-Demag GmbH (DE)

( * ) Notice: Subject to any disclaimer, the term of this patent is extended or adjusted under 35 U.S.C. 154(b) by 86 days.

(21) Appl. No.: 12/301,173

(22) PCT Filed: Apr. 26, 2007

(86) PCT No.: PCT/DE2007/000785

§ 371 (c)(1),
(2), (4) Date: May 1, 2009

(87) PCT Pub. No.: WO2007/131469

PCT Pub. Date: Nov. 22, 2007

(65) Prior Publication Data

US 2010/0038333 A1 Feb. 18, 2010

(30) Foreign Application Priority Data

May 16, 2006 (DE) ..... 10 2006 023 371

(51) Int. Cl.
*B66C 23/04* (2006.01)

(52) U.S. Cl. ..... 212/348; 212/350

(58) Field of Classification Search ..... 212/348, 212/350

See application file for complete search history.

(56) References Cited

U.S. PATENT DOCUMENTS

| | | | | | |
|---|---|---|---|---|---|
| 3,516,554 | A | * | 6/1970 | Nakamura | 212/348 |
| RE27,763 | E | * | 9/1973 | Fauchere | 212/348 |
| 4,392,573 | A | * | 7/1983 | Gyomrey | 212/230 |
| 4,690,290 | A | * | 9/1987 | Gustafsson | 212/349 |
| 6,186,347 | B1 | | 2/2001 | Reifenscheid et al. | |
| 6,234,453 | B1 | * | 5/2001 | Block | 254/285 |

FOREIGN PATENT DOCUMENTS

| | | | |
|---|---|---|---|
| DE | 43 43 782 C2 | | 6/1995 |
| GB | 2 042 456 | | 9/1980 |
| JP | 4-246092 | * | 1/1991 |
| JP | 5-155584 | * | 6/1993 |
| JP | 8-40691 | * | 2/1996 |

* cited by examiner

*Primary Examiner* — Emmanuel M Marcelo
(74) *Attorney, Agent, or Firm* — Cantor Colburn LLP

(57) ABSTRACT

A telescopic crane boom including a plurality of telescopically assembled tubular box sections including a base box section and an innermost box section having an open cross-section, and a boom head with a frame fixed to the outside circumference of the innermost box section. The head has a plurality of deflecting pulleys mounted on the frame, but no part extending inside the open cross section on the innermost base box section, whereby at least one additional box section can be inserted into the innermost box section in order to extend the boom.

14 Claims, 3 Drawing Sheets

TELESCOPIC CRANE BOOM

PRIORITY CLAIM

This is a U.S. national stage of application No. PCT/DE2007/000785, filed on 26 Apr. 2007. Priority is claimed on the following application(s): Country: Germany, Application No.: 10 2006 023 371.9, Filed: 16 May 2006, the content of which is/are incorporated here by reference.

BACKGROUND OF THE INVENTION

The invention pertains to a telescopic crane boom with a tubular base box section, with at least one box section mounted in telescopic fashion inside the base box section, and with a head with deflecting pulleys on the outward-facing end of the innermost box section.

PRIOR ART

The total weight of a mobile crane with telescopic boom allowed on public highways is determined by the permissible axle load (e.g., 12 tons or 12,000 kg in Germany) and the number of axles. Parts of the crane such as the counterweight and the main boom extension must often be transported separately to remain under the permissible axle loads. The length of the telescopic boom, which consists of rigid sheet metal box sections, also limits transportability and the maximum allowable weight per unit.

The last inner box section, that is, the innermost section of the boom, carries at its forward end a head with a set of pulleys to reeve the lifting cable, to reverse the direction of the lifting cable (feed pulley), and possibly to serve as points of attachment for a main boom extension and to accommodate bracing for the boom. The head is inserted into the interior of the box section, and the steel components and accessory parts of the head block it off for the most part and cannot be removed except by completely disassembling the inner box section.

If it is desired to extend the length of the telescopic boom by adding more inner box sections, these additional sections must be transported separately and installed at the construction site. For this purpose, the box section with the head, which has been innermost section up to now, must be removed first. Then, a box section without a head but with the same cross section and forward mount and possibly also with additional inner box sections, is pushed into place.

It is disadvantageous that it is first necessary to remove the innermost box section on which the head is mounted and the associated set of pulleys and that this section cannot be used again for the extended boom. This means that two box sections with the same cross section are required for an extension. After the extension has been installed, one of the box sections remains behind and has no use.

SUMMARY OF THE INVENTION

The invention is based on the object of decreasing the amount of disassembly and assembly work required to reconfigure a boom to make it longer and to avoid the situation of having a useless box section present on the construction site.

This object is achieved according to the invention for a telescopic crane boom with a tubular base box section, with at least one inner box section mounted in telescopic fashion inside the base box section, and with a head with deflecting pulleys on the outward-facing end of the innermost box section, in that the functions of the head and forward mount at the end of this innermost box section are integrated into a frame, which is arranged on the outside circumference of the box section in such a way that all of the parts belonging to the head are located outside the open cross section of the box section, and in that at least one additional box section can be inserted into this box section to extend the boom.

At least one additional boom head can be attached to the box section to be inserted.

The additional boom head is preferably attached to the innermost inner box section.

According to an embodiment of the invention, points of attachment for a main boom extension are provided on the innermost box section to be inserted.

The main boom extension can be a luffing boom extension or an adapter for a luffing boom extension.

According to another embodiment, the head can comprise at least one feed pulley, which is designed to pivot, to slide, or to be fitted on the head in such a way that it does not interfere with the open cross section.

It is also possible for the head to carry at least one feed pulley, which is designed to pivot, to slide, or to be fitted on the head in such a way that it can be brought into the open cross section by pivoting, sliding, or being fitted.

It is advantageous for the head to have transverse connectors connected to each other.

The set of pulleys can be arranged on the transverse connectors.

Points of attachment for bracing the boom can be located on the transverse connectors; or fork heads, serving as points of attachment for a boom extension, can be provided on the transverse connectors.

According to another embodiment, both sets of head pulleys can be used to reeve a bottom hook block.

It is also possible, however, for only the head pulley sets of the outer box section to be used to reeve a bottom hook block.

Finally, the set of head pulleys of the inner box section can be used to deflect of the cable, and it is also possible for the head of the boom to be mounted detachably on the box section.

According to the invention the functions of the head and forward mount are integrated into a frame, which is either permanently installed on or simply attached to the outside circumference of the inner box section of the boom or of some other box section, where the cross sections remain accessible without the need for extensive conversion work, as a result of which additional inner box sections can be inserted without the need to disassemble the box section to which the head is attached.

DETAILED DESCRIPTION OF THE PRESENTLY PREFERRED EMBODIMENTS

Figure 1:
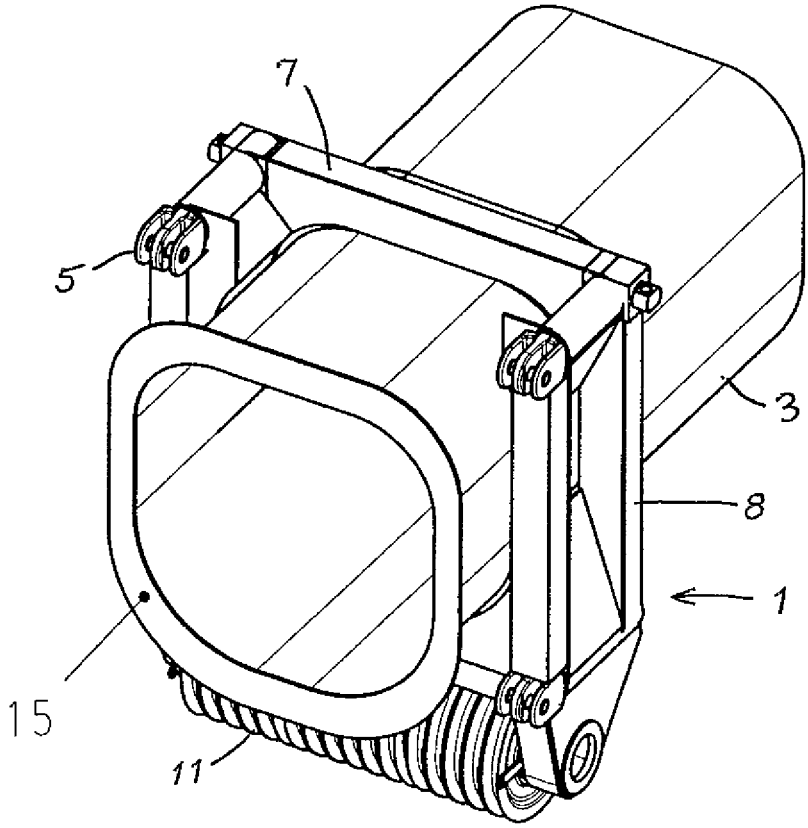
FIG. 1 shows the head with its set of pulleys mounted on the boom with inner box inserted.
Figure 2:
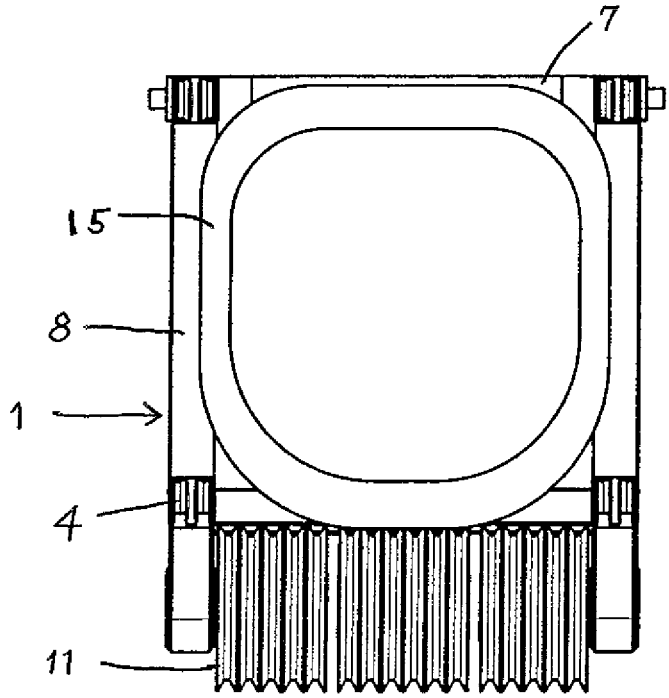
FIG. 2 shows an end view of the above.
Figure 3:
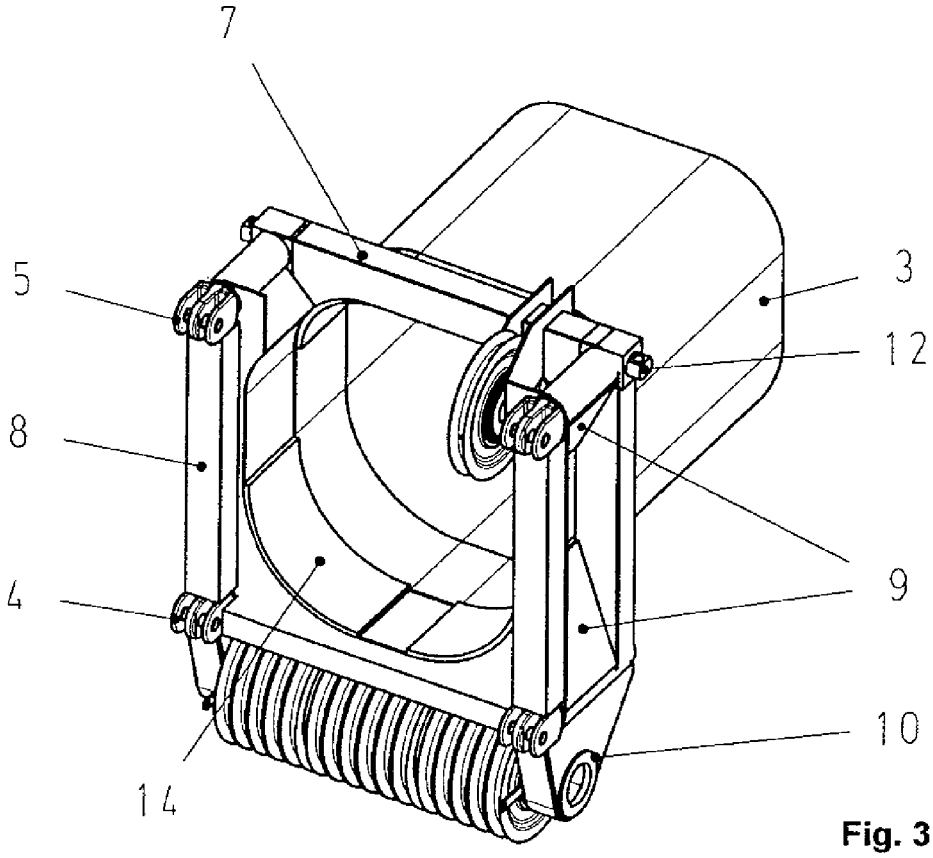
FIG. 3 shows a corresponding arrangement without inner box but with a feed pulley.
Figure 4:
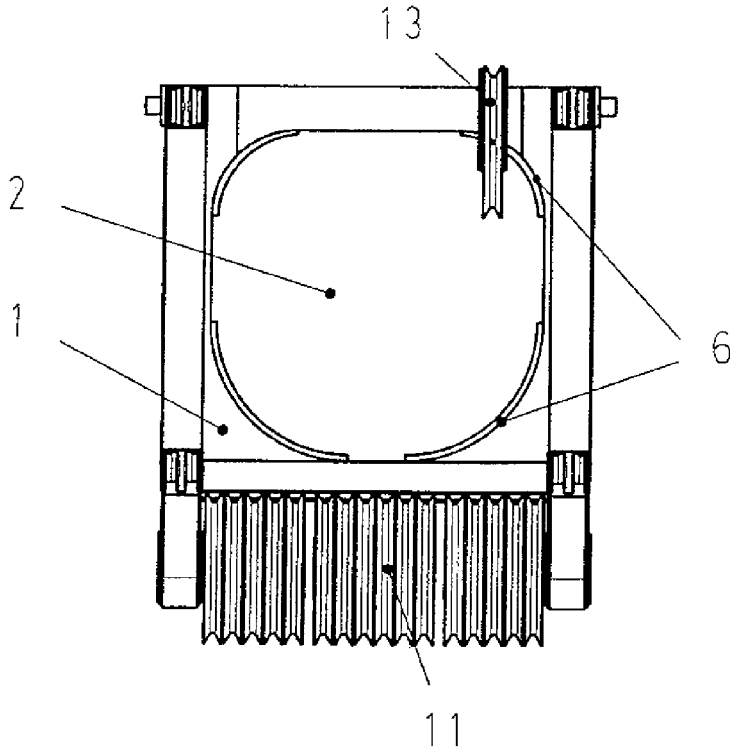
FIG. 4 shows an end view of the arrangement of FIG. 3.

The head 1 consists of a load-bearing steel structure, which is located completely outside the cross section 2 of the intermediate box section 3 of the boom. The fork heads 4, 5, serving as points of attachment for a main boom extension, are located outside the box radii 6 and are connected to each other horizontally by transverse connectors 7 and 8. At the same time, the fork heads are connected in the longitudinal direction by plates 9 to the box radii 6 to transmit forces into the box section 3 of the boom.

Brackets 10 for the set of pulleys 11 are connected to the lower fork heads 4, the forces on the pulleys being transmitted via the existing connections to the intermediate box section 3. At the rear of the upper fork heads 5, bracing points 12, one on the right, the other on the left, can be provided for the lateral bracing of the boom, for example, the forces of which are also transmitted via the existing connections to the box section 3 of the boom.

Figure 5:
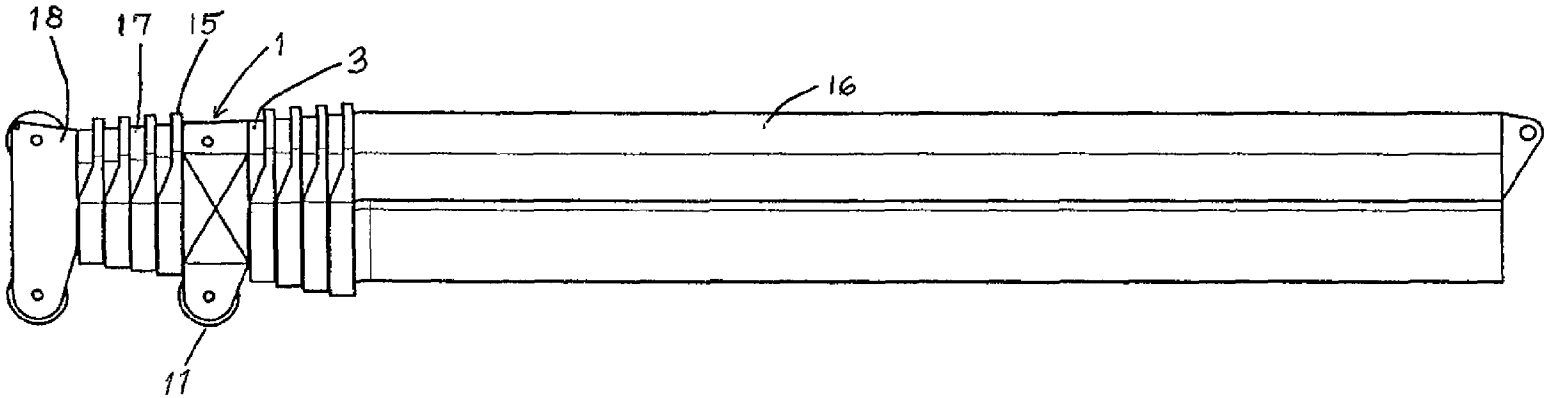
FIG. 5 is a side view showing the extension which can be achieved by an inventive embodiment offering the possibility of simultaneous dual-head/dual-hook operation.
Figure 6:
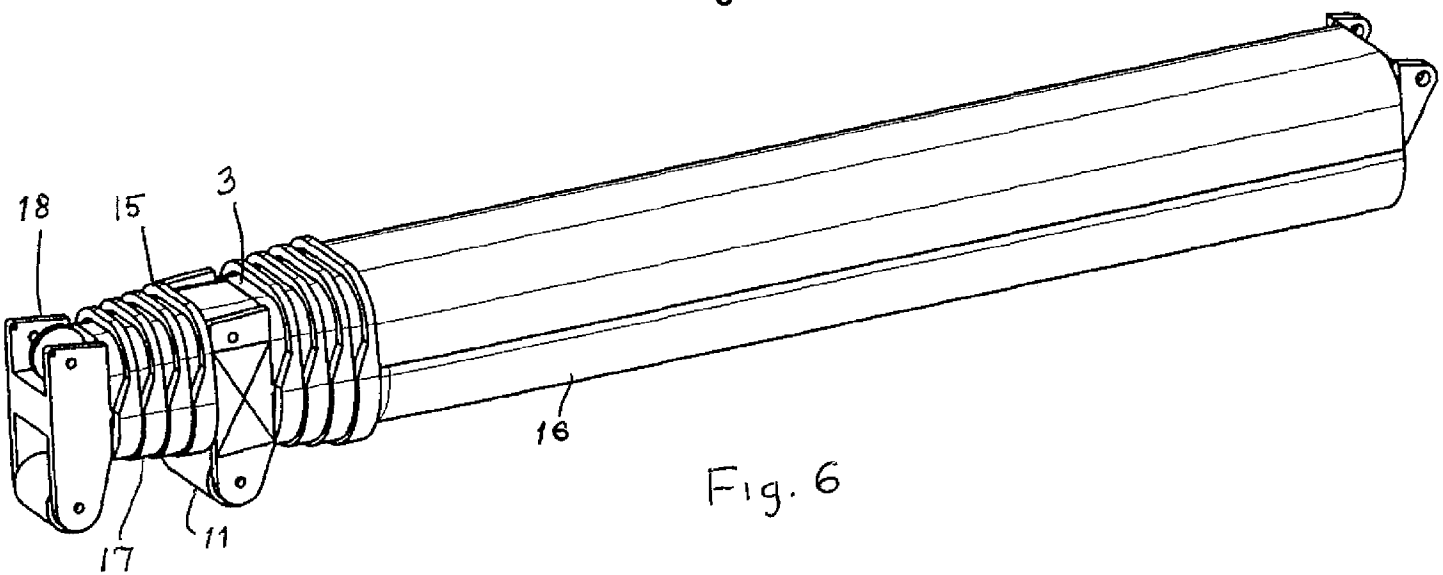
FIG. 6 is a perspective view of the dual head arrangement shown in FIG. 5.

At least one feed pulley for the set of pulleys 11 is located between the upper fork heads 5. This feed pulley can also be designed to be movable in the width direction to minimize the deflection angle of the cable when different reevings are selected. If this moveable feed pulley 13 projects into the cross section 2, it must be slid, turned, or lifted away from the cross section to allow additional box sections to be inserted into intermediate box section 3, as seen in FIGS. 5 and 6. It is also possible to install the feed pulley 13 outside the cross section 2, so that there is no need to remove it from that area.

Slideway linings 14 are installed in the radii 6 of the box section 3, the cross section 2 of which remains preserved all the way to the end of the head 1. The slideway linings 14 assume the function of guiding and supporting a first box section 15 to be telescopically inserted into the intermediate section 3. It will be appreciated that first box section 15 is telescopically disposed in intermediate box section 3 in a first position and telescopically extends from intermediate box section 3 in a second position.

The transverse connectors 7, 8 of the fork heads 4, 5 stiffen the box cross section 2, as a result of which bearing forces can be absorbed.

FIGS. 5 and 6 show a second boom head 18 fixed to a forward or innermost box section, and the progressively larger telescopic box sections, including base box section 16, in which intermediate box section 3 is received. According to the invention, the first box section 15 of an extended boom is received through head 1 into section 3. The invention allows that head 1 need not be removed in order to add additional inner sections 17. Additional inner sections 17, in turn are telescopically received in the first box section 15 to support the additional second boom head 18. It will be appreciated the invention allows any number of additional inner sections 17, between at least the first box section 15 and a fourth box section as shown in FIGS. 5 and 6. Obviously additional box sections can be added to the four box sections illustrated.

Another inventive benefit of a telescopic boom with two boom heads, in which, therefore, one head is present on the end of the boom and other head is mounted on one of the other box sections, is the possibility of dual-hook operation for the rotation of loads.

The invention claimed is:

1. A telescopic crane boom comprising:

a plurality of telescopically assembled tubular box sections including a base box section and an intermediate box section having an outside circumference and an open cross-section;

a first boom head comprising a frame fixed to the outside circumference of the intermediate box section, the head having a plurality of deflecting pulleys mounted on the frame, the head having no part extending inside the open cross section on the innermost box section; and a first box section telescopically disposed in the intermediate box section in a first position and telescopically extending from the intermediate box section in a second position in order to extend the boom.

2. The telescopic crane boom of claim 1 further comprising;

a second box section telescopically disposed in the first box section.

3. The telescopic crane boom of claim 2 wherein the second box section includes a second boom head being fixed to an outside circumference of the second box section.

4. The telescopic crane boom of claim 3 wherein the second boom head carries head pulleys, wherein both the deflecting pulleys and the head pulleys can be used to reeve a bottom hook block.

5. The telescopic crane boom of claim 3 wherein the second boom head carries head pulleys, wherein only said head pulleys can be used to reeve a bottom hook block.

6. The telescopic crane boom of claim 5 wherein the deflecting pulleys serve only to deflect the cable.

7. The telescopic crane boom of claim 1 wherein the head comprises at least one moveable feed pulley that does not interfere with the open cross section.

8. The telescopic crane boom of claim 7 wherein the head is designed so that the moveable feed pulley can be brought into the open cross-section by one of pivoting or sliding.

9. The telescopic crane boom of claim 1 wherein the frame comprises transverse connectors connected to each other.

10. The telescopic crane boom of claim 9 wherein the deflecting pulleys are carried by one of the transverse connectors.

11. The telescopic crane boom of claim 9 further comprising points of attachment for a boom extension provided on the transverse connectors.

12. The telescopic crane boom of claim 11 wherein the points of attachment are fork heads.

13. The telescopic crane boom of claim 1 including a second boom head being detachably fixed to the first box section.

14. The telescopic crane boom of claim 13, wherein the second boom head is detachably fixed to an outside circumference of the first box section.

* * * * *